US006835249B1

(12) United States Patent
Chingren

(10) Patent No.: US 6,835,249 B1
(45) Date of Patent: Dec. 28, 2004

(54) WALLPAPER DISPENSING APPARATUS

(76) Inventor: Misty Chingren, 3705 C St., Apt. 2, South Sioux City, NE (US) 68776

( * ) Notice: Subject to any disclaimer, the term of this patent is extended or adjusted under 35 U.S.C. 154(b) by 0 days.

(21) Appl. No.: 10/382,116

(22) Filed: Mar. 4, 2003

Related U.S. Application Data

(63) Continuation-in-part of application No. 09/833,303, filed on Apr. 12, 2001, now Pat. No. 6,540,834.

(60) Provisional application No. 60/387,524, filed on Jun. 7, 2002, provisional application No. 60/361,598, filed on Mar. 4, 2002, and provisional application No. 60/197,155, filed on Apr. 13, 2000.

(51) Int. Cl.[7] ..... B05D 1/28

(52) U.S. Cl. ..... 118/429; 118/DIG. 17

(58) Field of Search ..... 118/DIG. 17, 419, 118/423, 40, 429; 156/575, 578, 527, 524; 206/385, 389; 33/734, 772

(56) References Cited

U.S. PATENT DOCUMENTS 360,378 A * 3/1887 Chester
3,368,522 A * 2/1968 Cordis
5,336,323 A * 8/1994 Cotton et al.

* cited by examiner

*Primary Examiner*—Brenda A. Lamb
(74) *Attorney, Agent, or Firm*—Suiter West PC LLO

(57) ABSTRACT

A wallpaper dispensing apparatus includes a tray with a ridge projecting from the bottom and extending transversely between the side walls to divide the tray into a forward pool section and a rearward trough section. A removable cover is attached to the forward pool section and includes a pair of depressions with guide surfaces on the bottom, spaced above the bottom of the tray to form a passageway between the cover and tray bottom. The cover has a rearward portion following a portion of the ridge, and a straight rearward edge extending transversely across the tray. An opening in the cover, extending from the forward edge permits the user to draw a strip of wallpaper from a roll located in the trough, through the passageway between the cover and tray, and out the forward end of the tray. Water in the pool portion wets the wallpaper as it is drawn from the dispensing apparatus.

36 Claims, 5 Drawing Sheets

WALLPAPER DISPENSING APPARATUS

CROSS-REFERENCE TO RELATED APPLICATIONS

The present application is continuation-in-part of application Ser. No. 09/833,303, filed Apr. 12, 2001 now U.S. Pat. No. 6,540,834, which claims the benefit under 35 U.S.C. §119(e) of U.S. Provisional Application No. 60/197,155, filed Apr. 13, 2000. The present application also claims the benefit under 35 U.S.C. §119(e) of U.S. Provisional Application No. 60/361,598, filed Mar. 4, 2002 and U.S. Provisional Application No. 60/387,524, filed Jun. 7, 2002 application Ser. No. 09/833,303; U.S. Provisional Application No. 60/197,155; U.S. Provisional Application No. 60/361, 598; and U.S. Provisional Application No. 60/387,524 are incorporated by reference herein in their entirety.

FIELD OF THE INVENTION

The present invention relates generally to apparatus for wetting prepasted wallpaper, and, more particularly, to an improved wallpaper dispensing apparatus for wetting, measuring, cutting, and otherwise preparing a strip of prepasted wallpaper for application to a wall.

BACKGROUND OF THE MENTION

Conventionally, noncommercial rolls of wallpaper are prepasted. More specially, paste is applied to the rearward face of wallpaper at the factory, and permitted to dry. The paper is then formed into a roll for sale.

The conventional method for wallpapering requires the user to first measure the wall, roll out a strip of wallpaper of an appropriate length and cut the strip. The rearward face of the wallpaper must then be wetted, in order to activate the glue or paste. Typically, the paper strip must be uniformly wetted with the glue in contact with water for a very short period of time, typically in the range of ten to twenty seconds. The paper is then generally folded over upon itself such that the prepasted faces are in contact, to activate the glue in a process known as "booking". The paper may then be installed on a wall, as desired.

There are several difficulties encountered when installing wallpaper. First, in order to cut the wallpaper strip to the appropriate length, the wallpaper roll must be unrolled, the remaining roll being restrained while the elongated strip is measured. It is then necessary to use a square, or other straightedge aligned perpendicular to the length of the strip at the appropriate location, and support the strip on a surface for cutting with a knife. In many cases, after cutting the paper, the user must reverse the roll of the paper in order to neutralize some of the "memory" which occurs in the paper by virtue of the paper being rolled at the factory.

The cut strip is then immersed as a roll or dipped in a conventional rectangular tray of water in an attempt to wet the rearward surface of the paper. The use of conventional rectangular trays for wetting the paper is convenient for space requirements, but does not necessarily provide a consistent and uniform result in wetting the adhesive over the length of the strip. The best results are obtained by contacting water to the prepasted fade of the wallpaper for a uniform amount of time over the entire length of the wallpaper strip. Without this uniformity, poor adhesion can result and bubbles or separating edges may occur in the installed wallpaper.

The non-uniform wetting of the paper occurs as the rolled piece is immersed in the tray of water. A second person is typically required to hold the cut strip under the surface of the water as the strip is then slowly withdrawn. It can be seen that the immersed end of the paper remains under water for a much longer period of time than the end that is first withdrawn from the water.

It is therefore desirable to provide an improved wallpaper dispensing apparatus that permits a single user to draw a strip of wallpaper through water to uniformly wet the strip. Such a wallpaper dispensing apparatus should permit a strip of wallpaper to be cut at the desired length as part of the wetting procedure, and should facilitate measurement and cutting of a length of wallpaper strip without assistance of a second person.

SUMMARY OF THE INVENTION

Accordingly, the present invention is directed to a wallpaper dispensing apparatus that permits a single user to draw a strip of wallpaper through water to uniformly wet the strip. The wallpaper dispensing apparatus permits a strip of wallpaper to be cut at the desired length as part of the wetting procedure, and facilitates measurement and cutting of a length of wallpaper strip without assistance of a second person.

In exemplary embodiments, the wallpaper dispensing apparatus of the present invention includes a tray with a ridge projecting from the bottom and extending transversely between the side walls to divide the tray into a forward pool section and a rearward trough section. A removable cover is attached to the forward pool section and includes one or more depressions with guide surfaces on the bottom, spaced above the bottom of the tray to form a passageway between the cover and tray bottom. The cover has a rearward portion following a portion of the ridge, and a straight rearward edge extending transversely across the tray. An opening in the cover, extending from the forward edge permits the user to draw a strip of wallpaper from a roll located in the trough, through the passageway between the cover and tray, and out the forward end of the tray. Water in the pool portion wets the wallpaper as it is drawn from the dispensing apparatus.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
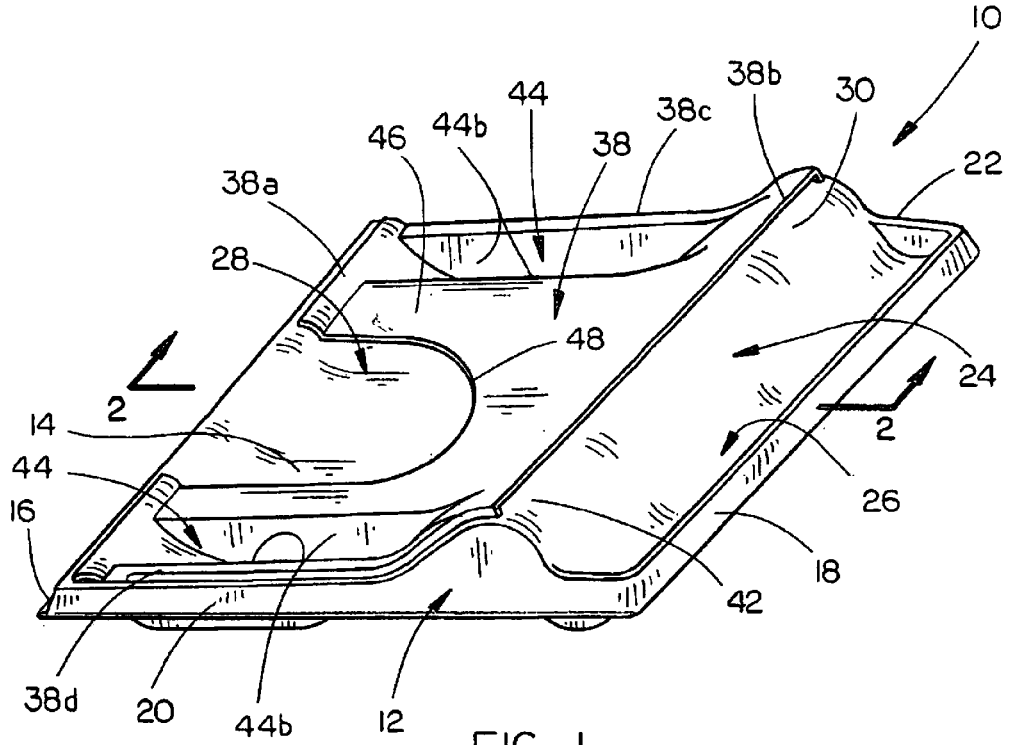
FIG. 1 is an isometric view illustrating a wallpaper dispensing apparatus in accordance with an exemplary embodiment of the present invention.

Referring now to FIG. 1, a wallpaper dispenser apparatus in accordance with an exemplary embodiment of the present invention is described. The wallpaper dispenser apparatus is designated generally at 10 and includes a generally rectangular tray 12 having a bottom 14, forward and rearward end walls 16 and 18, and opposing longitudinal side walls 20 and 22.

A transverse ridge 24 is formed in the bottom 14, which projects upwardly beyond the height of side walls 20 and 22, and extends between side walls 20 and 22. It can be seen that ridge 24 separates tray 12 into a rearward trough 26 between ridge 24 and rearward wall 18, and a forward pool 28 extending from ridge 24 to forward wall 16.

Figure 2:
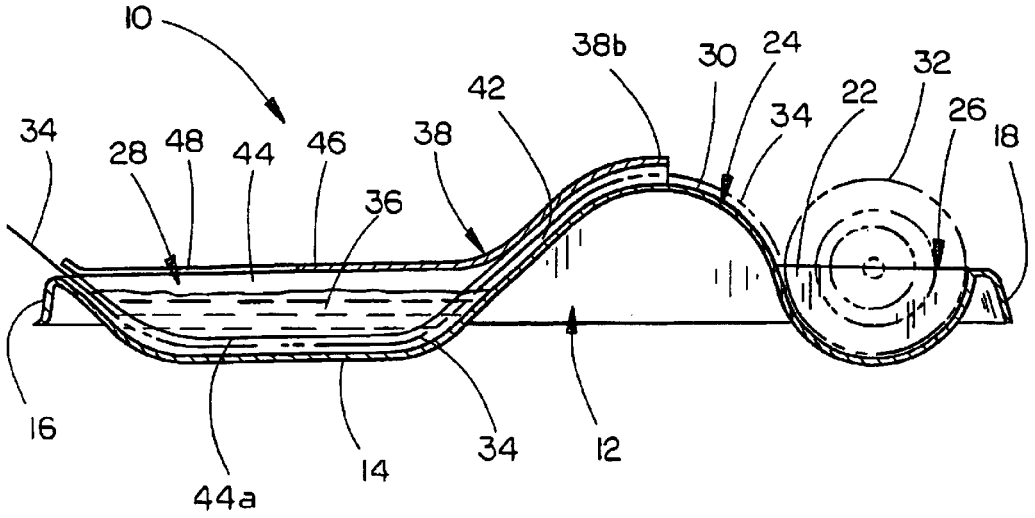
FIG. 2 is a cross-sectional side elevation view of the wallpaper dispensing apparatus shown in FIG. 1, taken at lines 2—2.

The upper surface 30 of ridge 24 is preferably curved to form a smooth connection with bottom 14, as shown in FIG. 2. Bottom 14 is also curved to assist in forming this smooth connection, and is also preferably curved at each end wall 16 and 18, to avoid sharp corners. Trough 26 is preferably semi-cylindrical in shape, to retain a roll 32 of wallpaper 34. The weight of the roll 32 maintains the roll within the trough as a wallpaper strip 34 is pulled from the roll 32.

Pool 28 is filled with water 36, as shown in FIG. 2, and wallpaper strip 34 is then dipped through the water 36 to wet the wallpaper as it is being drawn from roll 32. A cover 38 is mounted on tray 12 over pool 28, to assist in maintaining water 36 within the tray during the wetting process, and to guide the wallpaper strip 34 through water 36.

Cover 38 is a generally rectangular sheet of plastic material having forward and rearward edges 38*a* and 38*b*, and opposing side edges 38*c* and 38*d*. The rearward edge 38*b* of cover 38 is curved upwardly to follow the shape of the curvature of ridge 24, and the side edges 38*c* and 38*d* of the cover along ridge 24 have short side walls 40 spacing cover 38 parallel and above the surface 30 of ridge 24, to form a passageway 42 there between.

Depressions 44 are formed in cover 38 adjacent each side edge 38*c* and 38*d*, and extend from ridge 24 to the forward edge 38*a* of cover 38. The bottom surface 44*a* of each depression 44 is spaced slightly away from the tray bottom 14 to continue passageway 42 from ridge 24 along the bottom of pool 28, thence to the forward end wall 16 of tray 12. The wallpaper strip 34 may then be pulled from pool 28 between the forward edge 38*a* of cover 38 and the forward end wall 16 of tray 12.

Depressions 44 are separated by an intermediate portion 46 of cover 38. A large generally arch-shaped opening 48 extends rearwardly from the forward edge 38*a* of cover 38, into intermediate portion 46. Opening 48 permits the user to pull the wallpaper; strip 34 through the pool 28 and out the forward edge of tray 12.

As shown in FIG. 1, cover 38 has a width generally corresponding to the width of tray 12, with the side walls 44*b* of depressions 44 spaced a distance to form a tight fit between the side walls 20 and 22 of the tray 12. In this way, cover 38 is removable from tray 12 and is held in place by a friction fit between the side walls 44*b* of depressions 44 and the tray side walls.

The rearward edge 38*b* of cover 38 extends transversely between tray side walls 20 and 22, perpendicular to the length of the wallpaper strip 24. In this way, rearward edge 38*b* serves as a guide for cutting the wallpaper strip 34. The distance of travel of the wallpaper from rearward edge 38*b* of cover 38, under depression bottom walls 44*a*, to forward edge 38*a* is a known distance, preferably twelve inches, thereby permitting length of wallpaper to be measured as they are drawn from the wallpaper roll. Printed markings may also be formed on cover 38, preferably along opening 48, for morel precise measurements.

Figure 3:
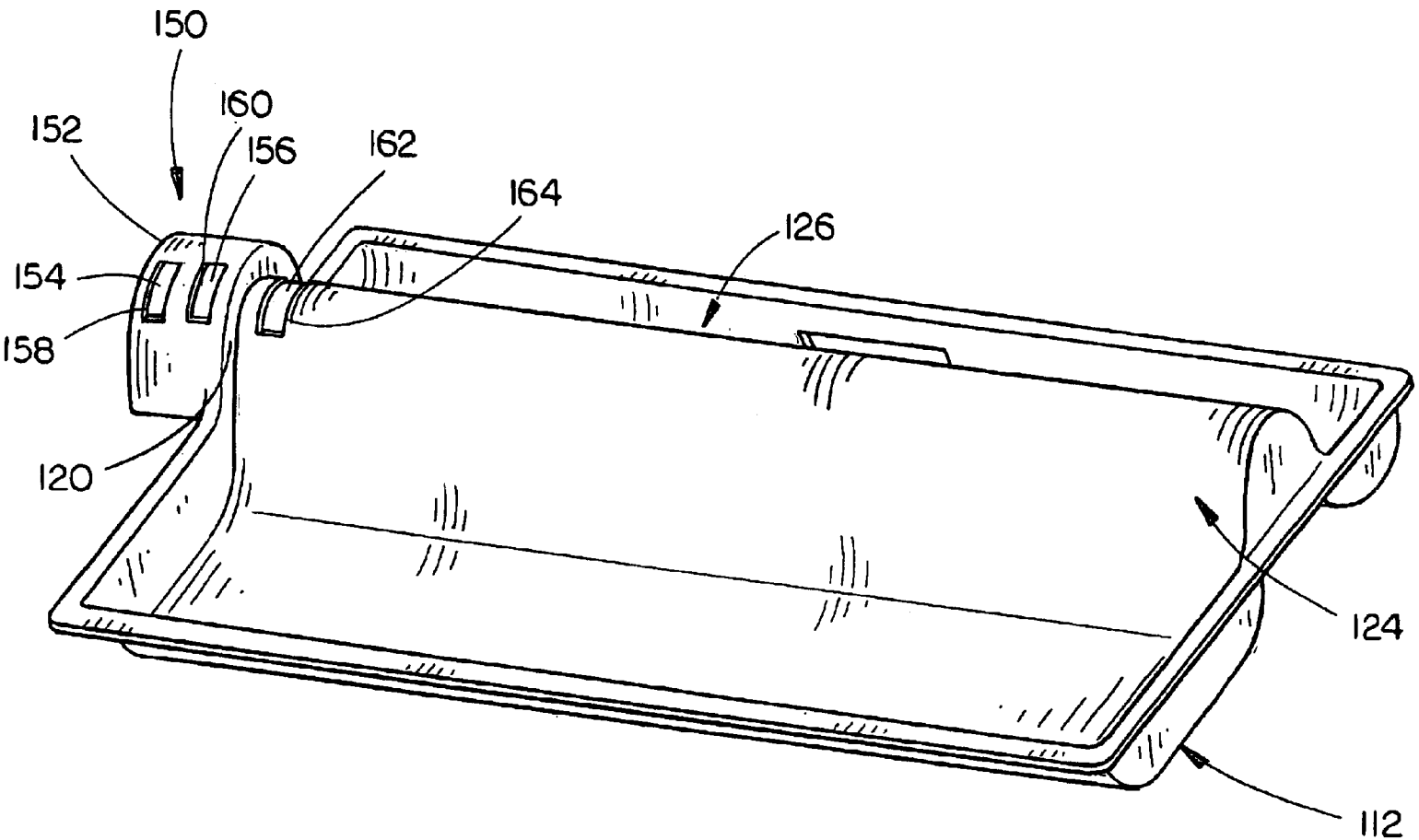
FIG. 3 is a an isometric view illustrating a wallpaper dispensing apparatus in accordance with a second exemplary embodiment of the present invention.
Figure 4:
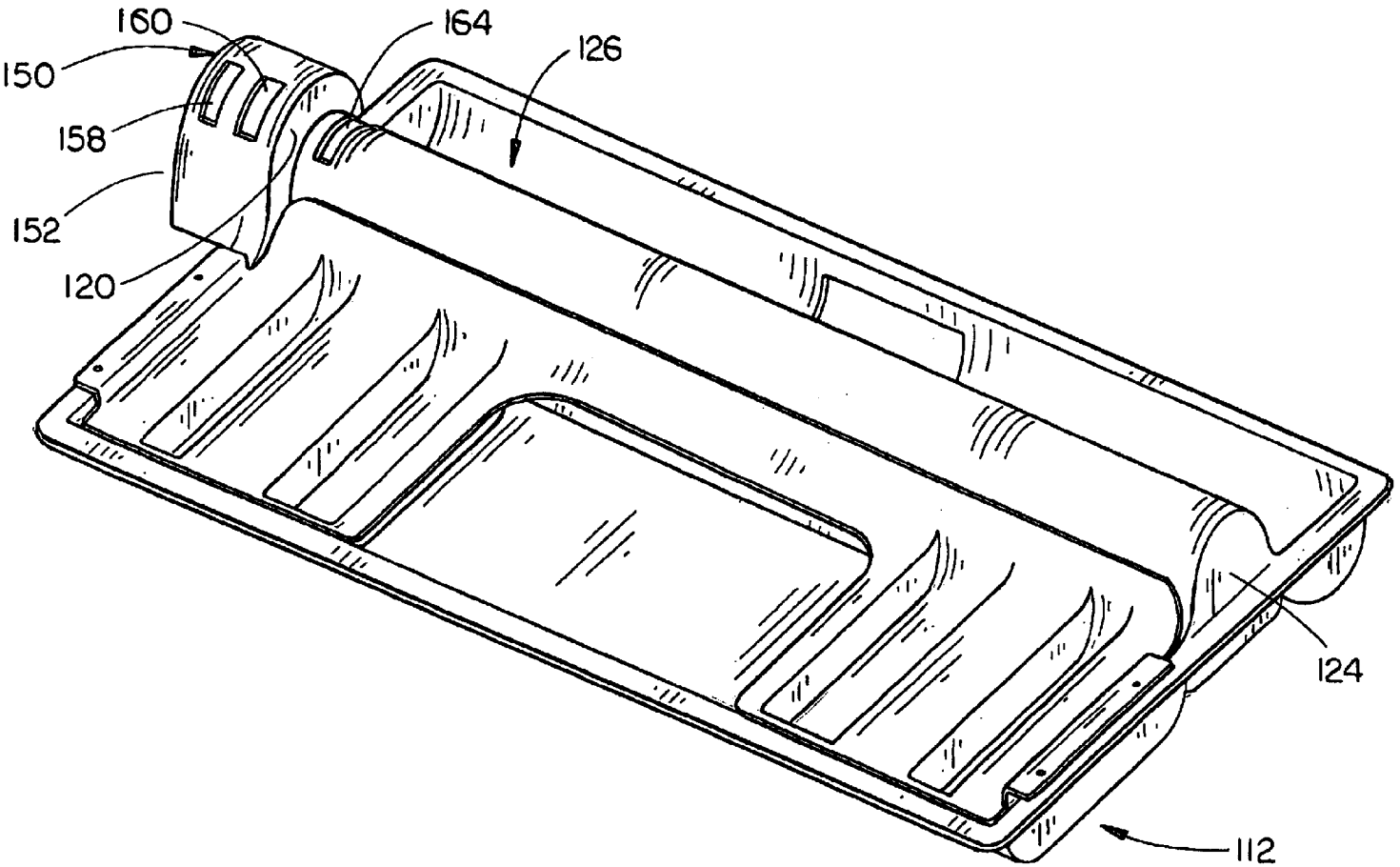
FIG. 4 is an isometric view of the wallpaper dispensing apparatus shown in FIG. 3 wherein the cover is removed.
Figure 5:
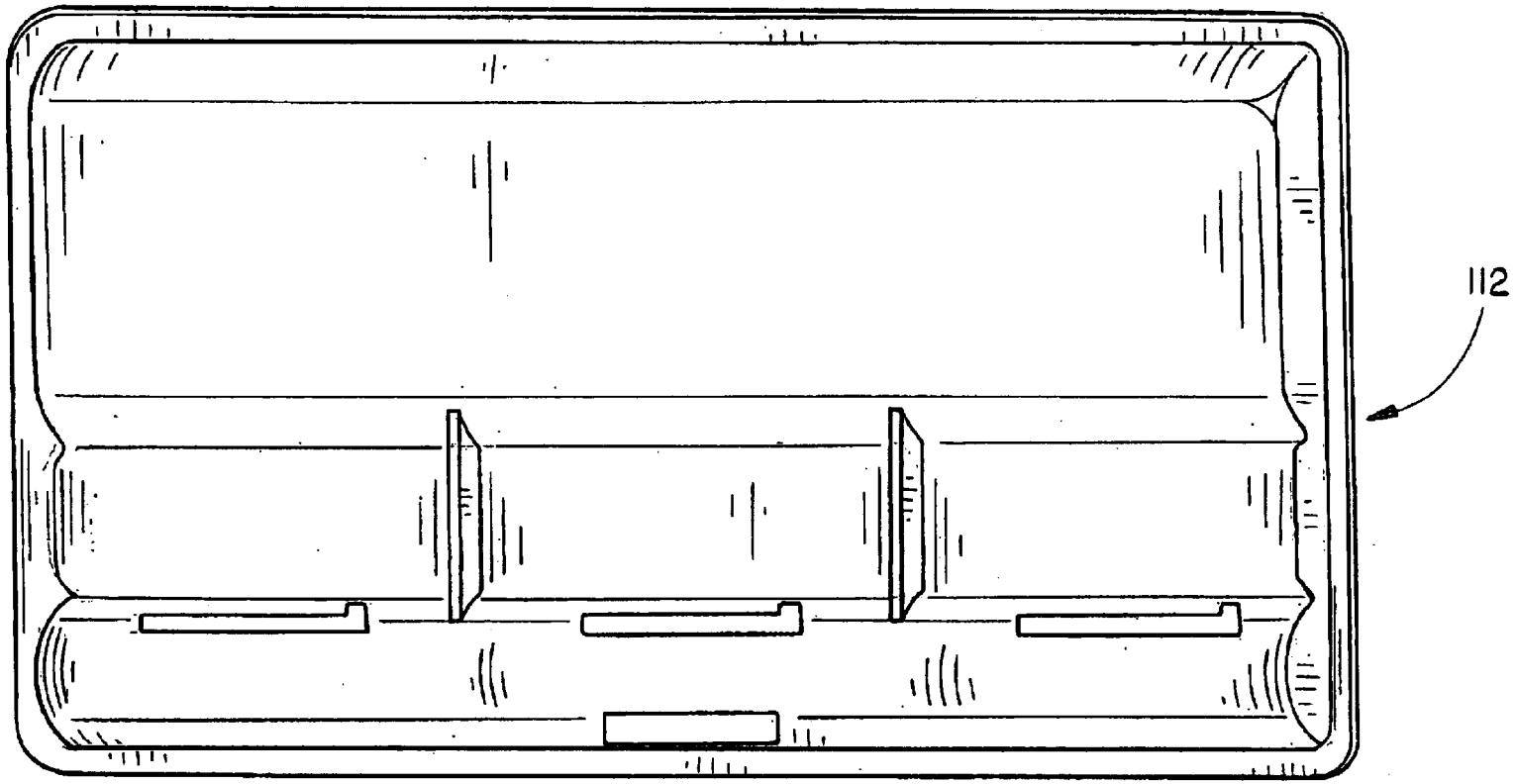
FIG. 5 is a bottom plan view of the tray of the wallpaper dispensing apparatus shown in FIG. 3.

Referring now to FIGS. 3 through 5, a wallpaper dispenser apparatus in accordance with a second embodiment of the present invention is described. This wallpaper dispenser apparatus is designated generally at 100 and includes a generally rectangular tray 112 having a bottom 114, forward and rearward end walls 116 and 118, and opposing longitudinal side walls 120 and 122.

A transverse ridge 124 is formed in the bottom 114, which projects upwardly beyond the height of side walls 120 and 122, and extends between side walls 120 and separating the tray 112 into a rearward trough 126 between ridge 124 and rearward wall 118, and a forward pool 128 extending from ridge 124 to forward wall 116.

The upper surface 130 of ridge 124 is preferably curved to form a smooth connection with bottom 114. Bottom 114 is also curved to assist in forming this smooth connection, and is also preferably curved at each end wall 116 and 118, to avoid sharp corners. As shown, trough 126 may be semi-cylindrical in shape, to retain a roll of wallpaper. Preferably, the weight of the roll maintains the roll within the trough as a wallpaper strip is pulled from the roll. However, it will be appreciated by those of skill in the art that retainers may be provided to further retain the roll of wallpaper within trough 126 without departing from the scope and spirit of the present invention.

As in the embodiment shown in FIGS. 1 and 2, pool 128 is filled with water allowing a wallpaper strip to be dipped through the water to wet the wallpaper as it is being drawn from the role. A cover 138 is mounted on tray 112 over pool 128 to assist in maintaining water 136 within the tray during the wetting process, and to guide the wallpaper strip 134 through water 136.

Cover 138 includes forward and rearward edges 138*a* and 138*b*, and opposing side rails 138*c* and 138*d*. The rearward edge 138*b* of cover 138 is curved upwardly to follow the shape of the curvature of ridge 124, and the side rails 138*c* and 138*d* support the cover on tray 112, spacing cover 138 parallel and above the surface 130 of ridge 124, to form a passageway 142 there between.

Depressions 144 are formed in cover 138, and extend from ridge 124 to the forward edge 138*a* of cover 138. The bottom surface 144*a* of each depression 144 is spaced slightly away from the tray bottom 114 to continue passageway 142 from ridge 124 along the bottom of pool 128, thence to the forward end wall 116 of tray 112. The wallpaper strip may then be pulled from pool 128 between the forward edge 138*a* of cover 138 land the forward end wall 116 of tray 112.

Depressions 144 are separated by an intermediate portion 146 of cover 138. An opening 148 extends rearwardly from the forward edge 138*a* of cover 138, into intermediate portion 146. Opening 148 permits the user to pull the wallpaper strip through the pool 128 and out the forward edge of tray 112.

As shown in FIG. 3, cover 138 has a width generally corresponding to the width of tray 112, with the side walls 144*b* of depressions 144 spaced a distance to form a tight fit between the side walls 120 and 122 of the tray 112. In this way, cover 138 is removable from tray 112 and is held in place between the side walls 144*b* of depressions 144 and the tray side walls.

As shown in FIGS. 3 and 4, a measuring device 150 is provided in tray 112 for measuring lengths of wallpaper cut from a role received in trough 126. In the exemplary embodiment shown in FIG. 3, measuring device 150 is comprised of a housing 152 formed in sidewall 120 of tray 112 adjoining transverse ridge 124. One or more measurement wheels 154 and 156 are disposed within housing 152. Measurement wheels 154 and 156 include measurement indicia (i.e., numbers hash marks, etc.) spaced about their circumference that serve as a guide for counting the length of wallpaper unrolled from the roll, and which are viewable through windows 158 and 160 formed in housing 152. Measurement wheels 154 and 156 are interconnected, via a shaft, transmission, gear mechanism, or the like, to a roller 162 disposed in transverse ridge 124. As shown in FIG. 4, roller 162 extends through an aperture 164 formed in transverse ridge 124 so that it may contact the wallpaper strip as it is unrolled from the roll received in trough 126. Preferably, as the wallpaper strip is drawn across the transverse ridge 124, it passes over roller 162, turning the roller 162 and advancing measurement wheels 154 and 156. In this manner, the length of the wallpaper strip passed over roller 158 may be provided by measurement indicia of measurement wheels 154 and 156. In exemplary embodiments, measurement wheels 154 and 156 may be interconnected to one another and roller 162 via a transmission allowing the wheels 154 and 156 to turn at different rates. For example, a first measurement wheel 154 may be geared to rotate through a fixed increment upon a predetermined number of revolutions of roller 162, while a second measurement wheel 156 is geared to rotate through a fixed increment upon a predetermined number of revolutions of the first measurement wheel 154. In such embodiments, the first measurement wheel 154 may include measurement indicia providing fine measurements (e.g., measurements in fractions of inches, centimeters, etc.), while the second measurement wheel 156 may include indicia providing gross measurements (e.g., measurements in feet, meters, etc.).

Figure 6:
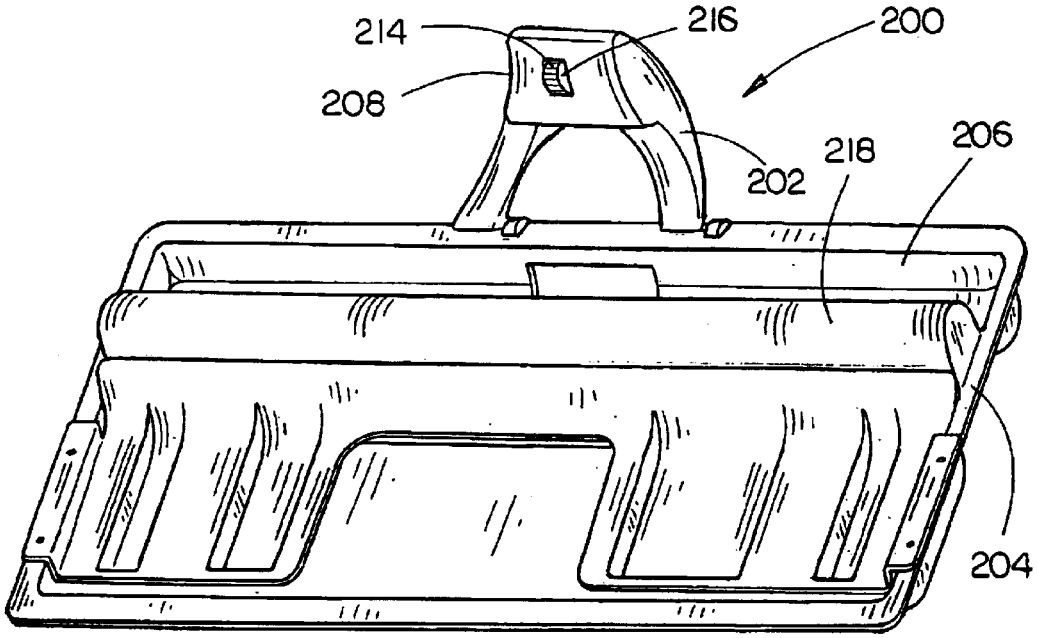
FIGS. 6 and 7 are isometric view illustrating a wallpaper dispensing apparatus in accordance with a third exemplary embodiment of the present invention.
Figure 7:
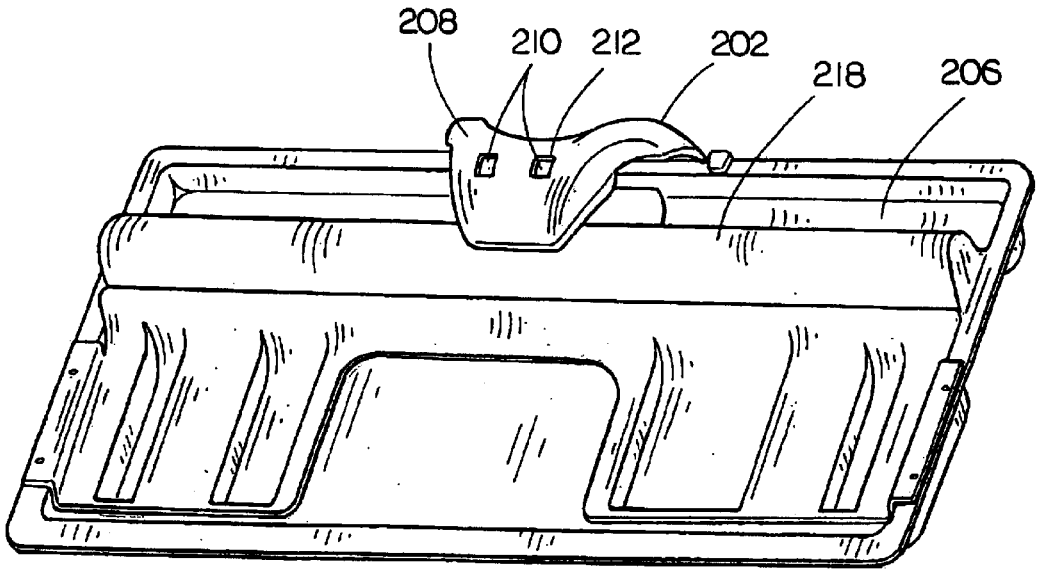

FIGS. 6 and 7 illustrate a wallpaper dispensing apparatus 200 in accordance with a third exemplary embodiment of the present invention. In this embodiment, wall paper dispensing apparatus 200 includes a measuring device 202 comprising an arm assembly attached to tray 204 for measuring lengths of wallpaper cut from a role received in trough 206. Measuring device 202 is comprised of a housing 208 having one or more arms pivotally attached to tray 202 at the rear edge of trough 206. One or more measurement wheels 210 are disposed within housing 206. Measurement wheels 210 include measurement indicia (i.e., numbers, hash marks, etc.) spaced about their circumference that serve as a guide for counting the length of wallpaper unrolled from the roll, and which are viewable through windows 212 formed in housing 208. Measurement wheels 210 are interconnected, via a transmission, gear mechanism, or the like, to a roller 214 extending through an aperture 216 formed in the bottom surface of housing 208 so that roller 214 may contact the wallpaper strip as it is unrolled from the roll received in trough 206. Preferably, as the wallpaper strip is drawn across the transverse ridge 218, it passes under roller 214, turning the roller 214 and advancing measurement wheels 210. In this manner, the length of the wallpaper strip passed under roller 214 may be provided by measurement indicia of measurement wheels 210. In exemplary embodiments, measurement 210 may be interconnected to one another and roller 214 via a transmission allowing the 210 to turn different rates. For example, a first measurement wheel may be geared to rotate through a fixed increment upon a predetermined number of revolutions of roller, while a second measurement wheel is geared to rotate through a fixed increment upon a predetermined number of revolutions of the first measurement wheel. In such embodiments, the first measurement wheel may include measurement indicia providing fine measurements (e.g., measurements in fractions of inches, centimeters, etc.), while the second measurement wheel may include indicia providing gross measurements (e.g., measurements in feet, meters, etc.).

It is believed that the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A wallpaper dispensing apparatus, comprising:

a tray having forward and rearward walls, opposing side walls, and a bottom;

a ridge in the bottom extending transversely between the side walls and forming a pool between the ridge and forward wall, and forming a trough between the ridge and rearward wall;

a cover extending between the side walls and proximal the ridge and forward wall for guiding a strip of wallpaper from a roll of wallpaper received in the trough past the ridge and through the pool; and a measuring device for measuring the length of the strip of wallpaper unrolled from the roll of wallpaper received in the trough, wherein the measurement device includes a housing formed in the tray, the housing having a window formed therein and at least one measurement wheel disposed within the housing and viewable through the window.

2. The wallpaper dispensing apparatus of claim 1, wherein said cover includes a rearward portion generally parallel to a top surface of the ridge, and a rearward edge located generally centrally over the ridge, said cover forming a passageway between the cover rearward portion and ridge top surface for journaling a strip of wallpaper.

3. The wallpaper dispensing apparatus of claim 2, wherein said cover includes a pair of spaced apart, parallel guide surfaces extending from the rearward portion forwardly to a forward edge of the cover, extending generally parallel and spaced above the bottom to continue the passageway from the ridge to the tray forward wall.

4. The wallpaper apparatus of claim 3, wherein said guide surfaces are formed on the bottom of a pair of depressions formed on the cover, with an intermediate portion of the cover extending between the depressions from the rearward portion of the cover to the cover forward edge.

5. The wallpaper apparatus of claim 4, wherein said cover intermediate portion has an opening formed therein extending rearwardly from the forward edge, permitting access to the pool of the tray.

6. The wallpaper dispensing apparatus of claim 5, wherein said cover rearward edge is straight, and extends perpendicularly to the side walls to form a straight cutting edge.

7. The wallpaper dispensing apparatus of claim 6, wherein said trough is generally semi-cylindrical in shape.

8. The wallpaper dispensing apparatus of claim 7, wherein said bottom, side walls and front end wall are formed of waterproof materials, and wherein said pool is capable of holding water therein.

9. The wallpaper dispensing apparatus of claim 8, wherein said cover is removably connected to the tray.

10. The wallpaper dispensing apparatus of claim 9, wherein said cover has a predetermined length, as measured from the rearward edge, through the passageway under the guide surfaces, to the forward edge.

11. The wallpaper dispensing apparatus of claim 3, wherein said cover has a predetermined length, as measured from the rearward edge, through the passageway under the guide surfaces, to the forward edge.

12. The wallpaper dispensing apparatus of claim 2, wherein said cover rearward edge is straight, and extends perpendicularly to the side walls to form a straight cutting edge.

13. The wallpaper dispensing apparatus of claim 1, wherein said trough is generally semi-cylindrical in shape.

14. The wallpaper dispensing apparatus of claim 1, wherein said bottom, side walls and frontward wall are formed of waterproof materials, and wherein said pool is capable of holding water therein.

15. The wallpaper dispensing apparatus of claim 1, wherein said cover is removably connected to the tray.

16. The wallpaper dispensing apparatus of claim 1, wherein the measurement wheels comprise measurement indicia for counting the length of wallpaper unrolled from the roll of wallpaper.

17. A wallpaper dispensing apparatus, comprising:

a tray having forward and rearward walls, opposing side walls, and a bottom;

a ridge in the bottom extending transversely between the side walls and forming a pool between the ridge and forward wall, and forming a trough between the ridge and rearward wall;

a cover extending between the side walls and proximal the ridge and forward wall, said cover including a rearward portion generally parallel to a top surface of the ridge, and a rearward edge located generally centrally over the ridge, said cover forming a passageway between the cover rearward portion and ridge top surface for journaling a strip of wallpaper, and a measuring device for measuring the length of the strip of wallpaper unrolled from the roll of wallpaper received in the trough, wherein said cover includes a pair of spaced apart, parallel guide surfaces for continuing the passageway from the ridge to the tray forward wall, and wherein the measurement device comprises a housing formed in the tray, the housing having a window formed therein, and a measurement wheel disposed within the housing and viewable through the window.

18. The wallpaper dispensing apparatus of claim 17, wherein the measurement wheels comprise measurement indicia for counting the length of wallpaper unrolled from the roll of wallpaper.

19. A wallpaper dispensing apparatus, comprising:

a tray having forward and rearward walls, opposing side walls, and a bottom;

a ridge in the bottom extending transversely between the side walls and forming a pool between the ridge and forward wall, and forming a trough between the ridge and rearward wall;

a cover extending between the side walls and proximal the ridge and forward wall for guiding a strip of wallpaper from a roll of wallpaper received in the trough past the ridge and through the pool; and a measuring device for measuring the length of the strip of wallpaper unrolled from the roll of wallpaper received in the trough, wherein the measuring device comprises a housing having an arm assembly attached to the tray, the housing having a window formed therein, and at least one measurement wheel disposed within the housing and viewable through the window.

20. The wallpaper dispensing apparatus of claim 19, wherein said cover includes a rearward portion generally parallel to a top surface of the ridge, and a rearward edge located generally centrally over the ridge, said cover forming a passageway between the cover rearward portion and ridge top surface for journaling a strip of wallpaper.

21. The wallpaper dispensing apparatus of claim 20, wherein said cover includes a pair of spaced apart, parallel guide surfaces extending from the rearward portion forwardly to a forward edge of the cover, extending generally parallel and spaced above the bottom to continue the passageway from the ridge to the tray forward wall.

22. The wallpaper apparatus of claim 21, wherein said guide surfaces are formed on the bottom of a pair of depressions formed on the cover, with an intermediate portion of the cover extending between the depressions from the rearward portion of the cover to the cover forward edge.

23. The wallpaper apparatus of claim 22, wherein said cover intermediate portion has an opening formed therein extending rearwardly from the forward edge, permitting access to the pool of the tray.

24. The wallpaper dispensing apparatus of claim 23, wherein said cover rearward edge is straight, and extends perpendicularly to the side walls to form a straight cutting edge.

25. The wallpaper dispensing apparatus of claim 24, wherein said trough is generally semi-cylindrical in shape.

26. The wallpaper dispensing apparatus of claim 25, wherein said bottom, side walls and frontward wall are formed of waterproof materials, and wherein said pool is capable of holding water therein.

27. The wallpaper dispensing apparatus of claim 26, wherein said cover is removably connected to the tray.

28. The wallpaper dispensing apparatus of claim 27, wherein said cover has a predetermined length, as measured from the rearward edge, through the passageway under the guide surfaces, to the forward edge.

29. The wallpaper dispensing apparatus of claim 20, wherein said cover rearward edge is straight, and extends perpendicularly to the side walls to form a straight cutting edge.

30. The wallpaper dispensing apparatus of claim 19, wherein said cover is removably connected to the tray.

31. The wallpaper dispensing apparatus of claim 30, wherein said cover has a predetermined length, as measured from the rearward edge, through the passageway under the guide surfaces, to the forward edge.

32. The wallpaper dispensing apparatus of claim 19, wherein said trough is generally semi-cylindrical in shape.

33. The wallpaper dispensing apparatus of claim 19, wherein said bottom, side walls and front end wall are formed of waterproof materials, and wherein said pool is capable of holding water therein.

34. The wallpaper dispensing apparatus of claim 19, wherein the measurement wheels comprise measurement indicia for counting the length of wallpaper unrolled from the roll of wallpaper.

35. A wallpaper dispensing apparatus, comprising:

a tray having forward and rearward walls, opposing side walls, and a bottom;

a ridge in the bottom extending transversely between the side walls and forming a pool between the ridge and forward wall, and forming a trough between the ridge and rearward wall;

a cover extending between the side walls and proximal the ridge and forward wall, said cover including a rearward portion generally parallel to a top surface of the ridge, and a rearward edge located generally centrally over the ridge, said cover forming a passageway between the cover rearward portion and ridge top surface for journaling a strip of wallpaper; and a measuring device for measuring the length of the strip of wallpaper unrolled from the roll of wallpaper received in the trough, wherein said cover includes a pair of spaced apart parallel guide surfaces for continuing passageway from the ridge to the tray forward wall, and wherein the measuring device comprises a housing having an arm assembly attached to the tray, the housing having a window formed therein, and a measurement wheel disposed within the housing and viewable through the window.

36. The wallpaper dispensing apparatus of claim 35, wherein the measurement wheels comprise measurement indicia for counting the length of wallpaper unrolled from the roll of wallpaper.

* * * * *